US007015437B2

(12) United States Patent
Johnston et al.

(10) Patent No.: US 7,015,437 B2
(45) Date of Patent: Mar. 21, 2006

(54) METHOD DEVICE FOR HEATING FLUIDS

(75) Inventors: Thomas Johnston, Lubbock, TX (US); Timothy Vaughn, Lubbock, TX (US)

(73) Assignee: TriFact Solutions, Inc., Lubbock, TX (US)

( * ) Notice: Subject to any disclaimer, the term of this patent is extended or adjusted under 35 U.S.C. 154(b) by 0 days.

(21) Appl. No.: 10/733,797

(22) Filed: Dec. 11, 2003

(65) Prior Publication Data

US 2004/0184794 A1 Sep. 23, 2004

Related U.S. Application Data

(60) Provisional application No. 60/432,494, filed on Dec. 11, 2002.

(51) Int. Cl.
*H05B 6/16* (2006.01)

(52) U.S. Cl. ..... 219/653; 392/465; 392/407

(58) Field of Classification Search ..... 392/465–466, 392/480, 483, 407, 411, 416, 422
See application file for complete search history.

(56) References Cited

U.S. PATENT DOCUMENTS

| | | | | |
|---|---|---|---|---|
| 4,032,748 | A * | 6/1977 | Vischer et al. | 392/396 |
| 5,054,107 | A | 10/1991 | Batchelder | |
| 5,790,752 | A | 8/1998 | Anglin et al. | |
| 6,131,536 | A | 10/2000 | Kujawa | |
| 6,148,145 | A | 11/2000 | Kadotani | |
| 6,157,778 | A | 12/2000 | Kadotani | |
| 6,190,162 | B1 | 2/2001 | Smith et al. | |
| 6,236,810 | B1 | 5/2001 | Kadotani | |
| 6,621,984 | B1 | 9/2003 | Castañeda et al. | |
| 6,687,456 | B1 | 2/2004 | Woo et al. | |
| 2003/0135250 | A1 | 7/2003 | Lauman et al. | |
| 2003/0221686 | A1 | 12/2003 | Ahmady | |
| 2004/0013988 | A1 | 1/2004 | Kim | |

FOREIGN PATENT DOCUMENTS

| | | | |
|---|---|---|---|
| EP | 0 864 827 | A1 | 9/1998 |
| EP | 1 096 203 | A1 | 5/2001 |
| WO | WO 01/56638 | A1 | 8/2001 |
| WO | WO 02/27247 | A1 | 4/2002 |
| WO | WO 03/061740 | A1 | 7/2003 |

* cited by examiner

*Primary Examiner*—Thor S. Campbell
(74) *Attorney, Agent, or Firm*—William D. Wiese

(57) ABSTRACT

This present invention for an in-line fluid heater suitable for heating ultrapure fluids utilizes a radiant energy source that generates infrared radiation to heat a fluid. The fluid to be heated is passed through a vessel such as a tube. The vessel, formed of PFA or polytetraflouroethylene, is coiled around the lamp or lamps. A chamber surrounds the lamp or lamps and the vessel. A temperature sensor at the outlet end of the vessel sends a signal to a controller that adjusts either the flow of fluid through the vessel or the intensity of the lamp or lamps, thereby controlling the fluid temperature at the outlet. The system is useful in any application requiring an ultraclean, non-contact method of raising the temperature of various liquids and gases.

10 Claims, 2 Drawing Sheets

METHOD DEVICE FOR HEATING FLUIDS

REFERENCE TO RELATED APPLICATION

This present application claims benefit from U.S. Provisional Patent Application Ser. No. 60/432,494 filed Dec. 11, 2002 in the names of Thomas Johnston and Tim Vaughn entitled "Method and System for Rapid Heating of Ultrapure Liquid."

BACKGROUND OF THE INVENTION

1. Field

The system and method of the present invention pertains to the field of heaters for fluids; more particularly, the inline heating of a fluids in a confined space without introducing contaminates to the fluid being heated.

2. Background

Heated ultrapure fluids are used for a variety of reasons. For example, hot fluids are required during several processing steps in the manufacture of an integrated circuit. It is typically impractical to first heat the fluids and then purify it and, because of the miniaturized scale of microcircuits and the critical manufacturing tolerances required in their production, virtually any impurity in the etching or rinsing fluid can result in defective parts and, consequently, wasted resources. Accordingly, it is preferable to start with a pure fluid and then heat it to the desired temperature.

Traditional heat exchange systems are unable to meet the demands of today's integrated circuit manufacturing process. For example, in a coil heat exchanger, a long, small diameter tube is placed concentrically within a larger tube, the combined tubes being bent or wound in a helix. A fluid of one temperature passes through the inner tube, and a second fluid of another temperature passes through the outer tube. The heat exchanger can be configured so that the liquid in the inner tube heats or cools the liquid in the outer tube or vice versa. This type of heat exchanger is generally capable of handling high pressures and wide temperature differences. Although these exchangers tend to be quite inexpensive, they tend to be quite large, they provide rather poor thermal performance because of the small heat transfer area, and they are antagonistic to ultrapure liquids.

Another traditional heat exchanger, the shell-and-tube type heat exchanger, consist of a bundle of parallel tubes that provide the heat transfer surface separating two fluid streams. The tube-side fluid passes axially through the inside of the tubes while the shell-side fluid passes over the outside of the tubes. Baffles external and perpendicular to the tubes direct the flow across the tubes and provide tube support. The shell-and-tube exchanger is efficacious in certain circumstances but has severe limitations in connection with integrated circuit processing, including the large size of the exchanger, thermal inefficiency and general intolerance for ultrapure liquids.

Heater manufacturers have sought to design devices acceptable for integrated circuit manufacturing which are thermally efficient, responsive to fluid flow changes, and capable of long life. For example, in order to maintain the purity required in integrated circuit processing filtering processes are employed to remove contaminants and deionize the fluid. Heat exchange systems are also generally designed to prevent contact between the contaminant-free fluid and any substance that would tend to corrode in the presence of the fluid, causing impurities to be reintroduced. Although most plastic materials tend to be good thermal insulators and therefore seemingly inappropriate for some uses in heating systems, most modem heaters for use in microchip manufacturing systems must employ plastics barriers to prevent the contaminant-free fluid from contacting the metallic heating element, lead wires and the like.

The prior art teaches a number of techniques for heating ultra-pure liquids. For example, in U.S. Pat. No. 4,461,347, issued Jul. 24, 1984, Layton et al., teaches immersing a heat source within a stream of the fluid to be heated. In this process, the heating element is contained within a non-reactive material to prevent contamination of the fluid. Heat is transferred to the fluid by conduction. As the heat from the heat source increases, the likelihood of contamination increases. Layton also teaches that the non-reactive sheath is preferably a plastic such as polytetraflouroethylene or polypropylene, both of which are thermally insulative, thereby reducing the efficiency of the transfer of heat to the fluid.

In U.S. Pat. No. 4,797,535, issued Jan. 10, 1989, Martin teaches heating a fluid by immersing a tungsten-halogen bulb in the fluid within a vessel, such as a pipe. As the fluid passes the bulb, heat transfers to the fluid. Martin does not appear to contemplate ultra-pure fluids, and no precautions are taken or taught for maintaining the purity of the fluid.

In U.S. Pat. No. 5,054,107, issued Oct. 1, 1991 Batchelder teaches a system for heating ultra-pure fluids. In particular, a quartz spiral or double walled tube is configured to surround several high intensity lamps. The fluid to be heated flows through the quartz tube. The lamps are not immersed in the fluid but radiate energy (infrared) outward through the tube and the liquid. The construction is wrapped in aluminum foil to reflect radiation that passes beyond the tube back through the fluid.

It is well recognized that the operative life of lamps of this type is greatly diminished as a result of high temperature operating conditions. Batchelder appears to recognize this and discloses a fixture for removing heat from the ends of the bulbs. Nevertheless, Batchelder teaches that up to twelve lamps can be mounted within the center of the quartz tube. These lamps will necessarily heat one another, thereby reducing the effective lifetime for the system, requiring more frequent routine maintenance for lamp replacement.

In U.S. Pat. No. 5,790,752, Anglin, et. al. teach a system for heating ultrapure liquids utilizing one or more elongated lamps that generate infrared radiation as the heating elements. In particular, the infrared lamps surround a vessel made of quartz through which liquid that is to be heated is passed. A quartz vessel, such as tubing, can be expensive and difficult to form into the desired configuration. In addition, the mass of the quartz present also absorbs some percentage of the infrared energy and keeps that amount of energy from being absorbed by the liquid being heated.

Accordingly, there exists a need for non-contaminating fluid heating systems which can efficiently and economically heat and maintain the fluid passing therethrough at a desired temperature. Further, a fluid heater is needed which is durable and capable of long, sustained use in harsh environments. Moreover, a fluid heater and control system is needed for preventing damage to the heater components and for ensuring that the fluid will be heated only to temperatures within acceptable limits. The present invention fulfills these needs and provides other related advantages.

SUMMARY

This present invention is for a fluid heater that is suitable for heating ultrapure fluids. The heater is useful in any application requiring an ultraclean, non-contact method of raising the temperature of a liquid or gas such as in the semiconductor industry, in heating circulating chemical baths, or in the medical industry for heating recirculated blood or heating medical gases.

The preferred system utilizes one or more lamps that generate infrared radiation as the heating elements. Fluid to be heated is passed through a vessel such as a tube. The vessel, formed of PFA or polytetraflouroethylene, is coiled around the lamp or lamps. A chamber surrounds the lamp or lamps and the vessel. A temperature sensor at the outlet end of the vessel sends a signal to a controller that adjusts either the flow of fluid through the vessel or the intensity of the lamp or lamps, thereby controlling the fluid temperature at the outlet.

One advantage of the present invention over the prior art is the elimination of the need for the use of a quartz vessel to hold the fluid, thereby reducing cost in acquiring and manufacturing the quartz vessel. Another advantage of the present system is that there are no coated metals in the heater core, thereby eliminating the possibility that the coating will degrade or flake over time and add impurities to the fluid. Yet another benefit is the ease of servicing the heater due to the wide availability of PFA tubing.

BRIEF DESCRIPTION OF THE DRAWING FIGURES

A better understanding of the system and method of the present invention may be had by reference to the drawing figures, wherein.

DESCRIPTION OF THE EMBODIMENTS

Figure 1:
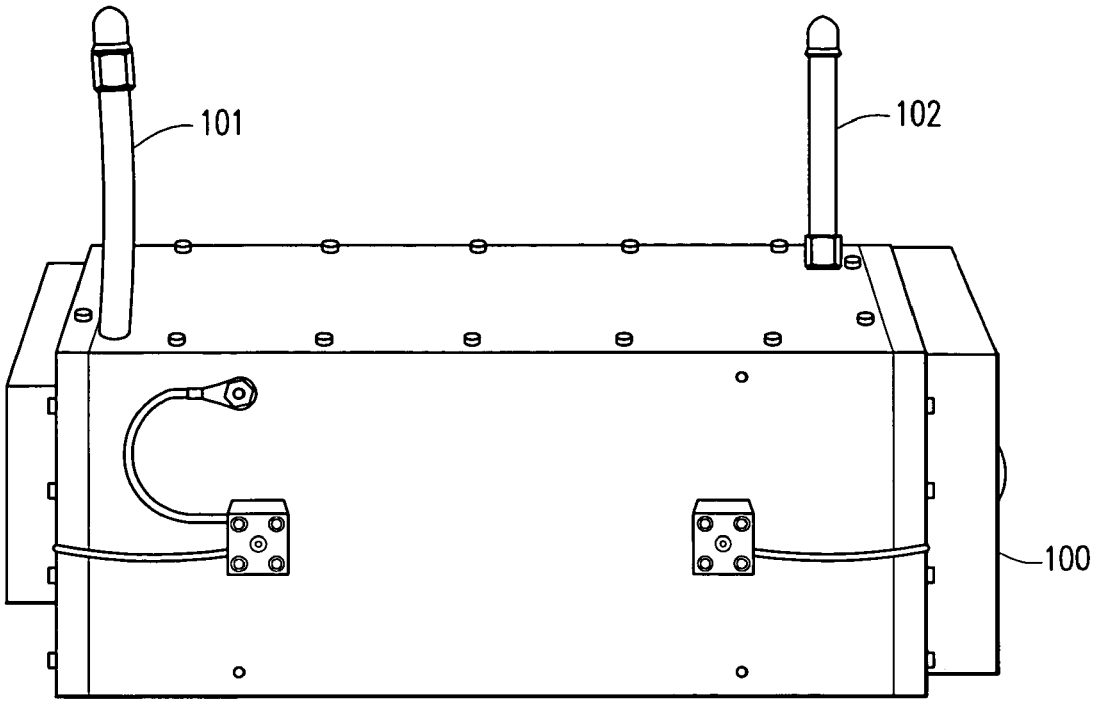
FIG. 1 shows a side view of the chamber for the heater of the present invention.

FIG. 1 shows a side view of the preferred chamber 100 for the present invention. An inlet end 101 to the vessel and an outlet end 102 to the vessel protrude from the chamber 100. It will be apparent to one of ordinary skill in the art that the material used to make the chamber should be lightweight and easy to mill but solid and durable for withstanding the rigors of processing such as, for example, aluminum.

The chamber 100 can be made of any material, however, there are advantages to making the interior of the chamber, or coating the interior of the chamber, with a material that reflects radiant energy. Because the radiant energy source 103 is located in the center of a coiled vessel 104, the energy is directed radially outward from the source. The reflective material on the inside of the chamber 100 reflects the radiant energy back toward the vessel 104, thereby providing additional heating capability to the vessel 104. The reflective material may be any of those known in the art, such as gold, polished aluminum, stainless steel or nickel plating. Accordingly the reflective material should be highly reflective of the radiation wavelength produced by the radiant energy source 103. The shape of the chamber 100 can be rectangular, as shown in FIG. 1, cylindrical, square, or any other configuration that will accommodate the radiant energy source 103 and vessel 104 discussed below.

The fluid to be heated enters the vessel 104 through the inlet end 101 and exits the vessel 104 through the outlet end 102. The inlet end 101 and outlet end 102 are preferably formed of an inert or nonreactive material to prevent contamination of the fluid. As is well known, the inlet end 101 and the outlet end 102 can be integrally formed with the vessel. The inlet end 101 and the outlet end 102 must each pass through an aperture in the wall of the chamber or through the end cap. Any convenient location for the apertures can be used.

Figure 2:
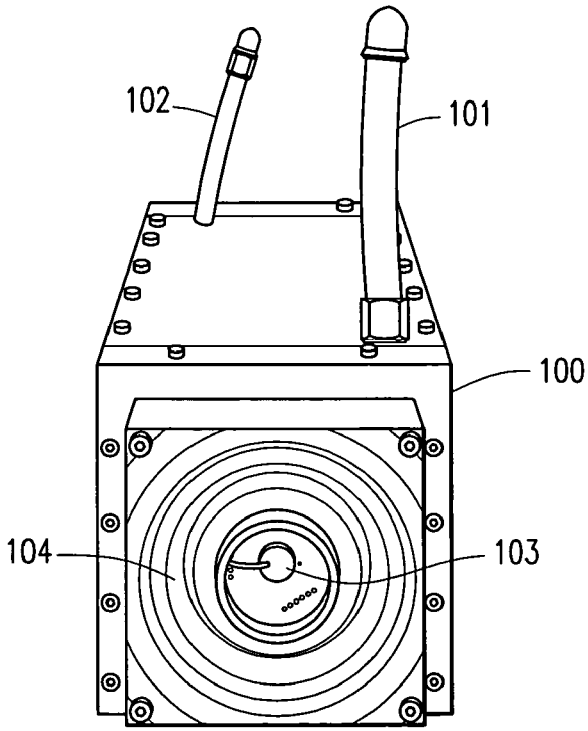
FIG. 2 shows an end view of the heater of the present invention.

FIG. 2 shows an end view of the preferred chamber 100 for the present invention. A vessel 104 is coiled around a radiant energy source 103. The radiant energy source 103 can be, for example, an infrared lamp or lamps but should have a wavelength at least as long as infrared. If the radiant energy source 103 is more than one lamp, the lamps can be configured in any of a number of different ways to optimize the energy emitted from lamps with respect to the vessel 104. The radiant energy source 103 is held in the chamber 100 by its ends, either by an attachment to the end plates of the chamber 100 or by an attachment to the vessel 104. The wavelength of the radiant energy source 103 may be adjusted to optimize performance so as to enhance efficiency of heat transfer to the fluid to be heated. Under certain circumstances, lamps having different operating characteristics can be selected to accommodate heating fluids having widely variant heat absorption properties.

The vessel 104 used to carry fluid to be heated is formed of an inert or non-reactive material to avoid contaminating the fluid. According to the preferred embodiment, the vessel 104 is formed of perfluoroalkoxy or polytetraflouroethylene. The size of the vessel 104 may vary. In the preferred embodiment, the chamber 100 size is no larger than 24 inches by 24 inches by 8 inches, the length of the vessel 104 within the chamber 100 is approximately 22 feet and the vessel 104 is capable of holding approximately 120 milliliters of fluid. The size of the vessel 104 can be adjusted in order to accommodate differing flow rates. Because the vessel 104 is coiled around the radiant energy source 103, the fluid remains in a heat exchange relationship with the fluid for a substantially longer time than if the vessel 104 ran substantially parallel to the radiant energy source 103. It is desirable that all the radiant energy produced by the lamps impinge onto the fluid to impart the greatest heating efficiency. Accordingly, the vessel 104 need not be coiled in a single layer around the radiant energy source 103 but that subsequent coils may overlap earlier coils. By doing so, those coiled portions of the vessel 104 in the second or subsequent layers absorb energy that has passed through the initial layer of coils, thereby providing a more efficient means of heating.

It should also be noted that the length of the chamber 100, and the corresponding vessel 104, was chosen for this system to accommodate a commercially available infrared lamp. Other lamps with other power ratings may be longer or shorter than the chosen lamp. It will be apparent to one of ordinary skill in the art after reading this disclosure that the chamber 100 and the vessel 104 can readily be made longer or shorter by appropriately cutting the extrusion to accommodate various lengths of lamps.

Figure 3:
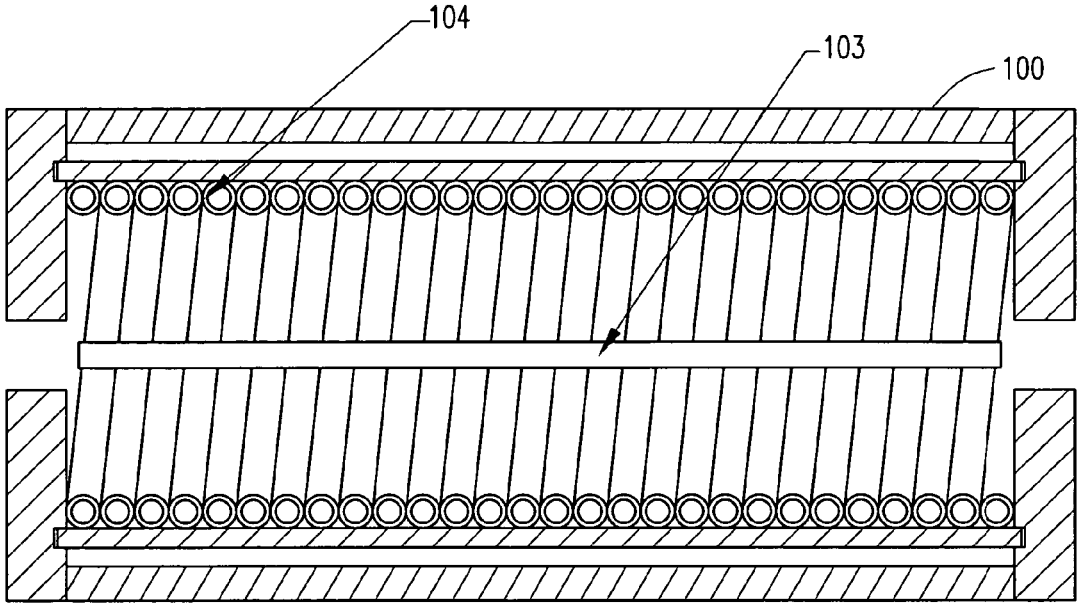
FIG. 3 shows a cross section view of the chamber of the preferred embodiment.

FIG. 3 shows a cross sectional schematic view of one embodiment. The vessel 104 is wound around the radiant energy source 103 in a heat exchange relationship with the vessel 104 within the chamber 100. Because of the small volume of fluid passing through the vessel 104 and the length of time in which the fluid remains in a heat exchange relationship with the fluid due to the coiling of the vessel 104 around the radiant energy source 103, it is possible to control the output temperature of a fluid in steady state flow to within a 0.1 degree Celcius tolerance. In addition, it is possible to start the heater from a stopped condition and to have the fluid leaving the outlet end 102 to be within 1 degree Celcius of the desired temperature.

Another feature of this invention is the control circuit used in adjusting the temperature of the fluid to be heated. In the preferred embodiment, a programmable temperature/process controller is attached to the outlet end 102. The controller monitors the temperature of the fluid at the outlet end 102 and compares it to a target value. If the deviation between the actual temperature and the target temperature varies more than an allowable amount, a signal is sent to the radiant energy source 103 whereby the power to the radiant energy source 103 may be increased or decreased to effect a change in the temperature of the fluid to be heated. In addition, deviations in the temperature may signal a defective radiant energy source 103, thereby allowing for repair or replacement with minimal downtime.

While the present system and method has been disclosed according to the preferred embodiment of the invention, those of ordinary skill in the art will understand that other embodiments have also been enabled. Such other embodiments shall fall within the scope and meaning of the appended claims.

We claim:

1. A method for heating fluid comprising:

carrying fluid to be heated through a vessel wherein said vessel is made from perfluoroalkoxy or polytetraflouroethylene;

said vessel is coiled around a radiant energy source; and said vessel and said radiant energy source are enclosed in a chamber;

heating said fluid with the energy radiating from said radiant energy source;

monitoring the temperature of said fluid at the outlet of said vessel with at least one temperature sensing device; and adjusting the flow of said fluid through said vessel or adjusting the energy emitted by said radiant energy source in response to changes in the temperature recorded during said monitoring.

2. The method of claim 1 wherein the inside surface of said chamber reflects radiant energy into said fluid.

3. The method of claim 1 wherein said vessel has a substantially round cross section.

4. The method of claim 1 further including a temperature sensor at said outlet of said vessel for monitoring a malfunction of said radiant energy source.

5. The method of claim 1 wherein additional radiant energy sources are located adjacent to said radiant energy source on the inside of said coiled vessel.

6. A heater for heating fluid comprising:

at least one radiant energy source;

a vessel for carrying a fluid to be heated wherein the vessel is made from perfluoroalkoxy or polytetraflouroethylene and said vessel is coiled around said radiant energy source;

a chamber surrounding said vessel and said radiant energy source;

at least one device for monitoring the temperature of said fluid at the outlet end of said vessel; and at least one control device for adjusting the radiation emitted from said radiant energy source in response to changes in the temperature recorded by said device for monitoring the temperature of said fluid.

7. The heater of claim 6 wherein the inside surface of said chamber reflects radiant energy into said fluid.

8. The method of claim 6 wherein at least one of said control devices at said outlet monitors for a malfunction of said radiant energy source.

9. A heater for heating a liquid comprising:

a chamber;

a vessel within said chamber for carrying a fluid to be heated, wherein said vessel is made from perfluoroalkoxy or polytetraflouroethylene and wherein said vessel has an inlet end and an outlet end;

at least one radiant energy source within said chamber wherein said vessel is wound around said at least one radiant energy source in a heat exchange relationship with said at least one radiant energy source; and a device for sensing the temperature of said fluid at said outlet end of said vessel and adjusting the intensity of said at least one radiant energy source in response to fluctuations in the temperature of said fluid.

10. A heater for heating a liquid comprising:

means for supplying radiant energy;

means for carrying a fluid to be heated wherein said means for carrying a fluid to be heated is wound around said means for supplying radiant energy;

means for enclosing said means for supplying radiant energy and said means for carrying a fluid to be heated;

means for sensing the temperature of said fluid to be heated wherein the intensity of said means for supplying radiant energy is adjusted in response to the temperature detected at the outlet of said means for carrying a fluid to be heated.

* * * * *